United States Patent [19]

Lundquist

[11] 4,005,794

[45] Feb. 1, 1977

[54] ADJUSTABLE PAPER GUIDE FOR COPYING MACHINES

[76] Inventor: Robert H. Lundquist, 172 E. 4635 North, Provo, Utah 84601

[22] Filed: Dec. 10, 1975

[21] Appl. No.: 639,355

[52] U.S. Cl. ..... 271/161; 271/171

[51] Int. Cl.[2] ..... B65H 1/00

[58] Field of Search ..... 271/145, 161, 171, 223

[56] References Cited

UNITED STATES PATENTS

| | | | |
|---|---|---|---|
| 1,869,708 | 8/1932 | Nowell | 271/171 |
| 3,807,725 | 4/1974 | Bookless | 271/171 |
| 3,921,972 | 11/1975 | Miller | 271/171 |

*Primary Examiner*—Richard A. Schacher

*Attorney, Agent, or Firm*—Criddle, Thorpe & Western

[57] ABSTRACT

A paper tray assembly for paper reproduction systems comprising a flat base, an upwardly extending backwall, paper guides and guide strips. Rectangular recesses are located in the corners of the base adjacent the backwall and coinciding recesses are found in the backwall. Longitudinal slots are contained in the rectangular recesses parallel the backwall. A paper guide is provided having floor, sidewall and endwall portions adapted to fit in the recesses. Transverse guide strips extend over the floor of the paper guide and across the base. The floor of said paper guides and said guide strips contain apertures which are in alignment with longitudinal slots. Fastening means are provided to fit through said apertures and slots thereby securing the paper guide and transverse guide strips in any desired position along the length of the longitudinal slot.

5 Claims, 4 Drawing Figures

ADJUSTABLE PAPER GUIDE FOR COPYING MACHINES

BACKGROUND OF THE INVENTION

This invention relates to paper tray assemblies for use in reproduction machines. More specifically, this invention relates to paper tray assemblies for reproduction machines, which paper trays are designed to eliminate paper jamming and clogging in said machines.

With the advent of the electrostatic reproduction systems, the so-called "photocopying" machines have become increasingly complex but capable of making any number of copies and utilizing a variety of paper stocks. However, due to the complexity of the machines, it is usually necessary to appoint a so-called "key operator" to monitor the activity of the machine and see that it is properly stocked with the right size and color of paper.

In many instances, it is desired to change from one size or color of paper to another and such change must usually be made by removing the current stock of paper within the copying machine and replacing it with the desired paper. Such a process may result in several paper changes each day, or hour, depending upon the demands put upon the copying machine.

Inexperienced operators often insert paper in an incorrect manner such that the papers become dog-eared or otherwise damaged. Often paper is placed in the copying machine with the wrong side of the paper up which results in jamming or clogging of the machine, and considerable downtime is required to open up the machine and pull out the paper. If a key operator is not available a machine may be out of operation for a period of several hours. The principal cause of misfeeds to the machine and the resulting paper jams is primarily due to improper placement of the copy paper into the machine's feeding mechanism. However, damaged, dog-eared corners and wrinkled sheets also contribute to this problem.

OBJECTS OF THE INVENTION

It is an object of the present invention to provide a paper tray assembly which significantly reduces paper jams in copying machines.

It is also an object of this invention to provide paper tray assembly which is adjustable and which may be readily inserted into a copying machine by an inexperienced operator.

It is a further object of this invention to provide a paper tray which allows a greater variety of paper stocks to be used without the necessity of unloading the entire paper stock from the machine each time it is desired to use a different size and/or color of paper.

It is a still further object of the present invention to provide a paper tray where papers are properly positioned relative to the feeding mechanism for transferring the paper into the copying machine thereby reducing misfeeds and the resulting paper jams.

These and other objects of the invention are accomplished by means of a paper tray assembly as will be described in detail hereinafter. Basically, the principal features of the invention include a flat base having a backwall extending therefrom at right angles along one side thereof. Preferably the backwall is a contiguous part of the base. The corners of the base adjacent to the sidewalls contain regular recesses which recesses contain a longitudinal slot. The inside inner portion of the sidewalls are also recessed, the sidewall recesses being coincidental with the rectangular recesses in the base. A pair of paper guides consisting of a floor, a backwall, and an endwall are adapted to fit into recesses and be slidably engaged therein. The floor contains an aperture which is in alignment with the longitudinal slot in the base recesses. In addition, the paper tray contains a pair of guide strips which overlay the floor of the paper guide and extend transversely across the width of the paper tray. The guide strips also contain apertures which, when placed over the floor of the paper guides, are adapted to be in alignment with the aperture in the floor of the paper guide and the longitudinal slot. Fastening means are inserted through the apertures which when tightened secure at the paper guides and guide strips in a fixed position, but when loosened allow for the longitudinal movement of the said strips and paper guides within the longitudinal slots.

The novelty of this invention both as to the manner of construction or organization as well as the operation thereof will be better understood with reference to the following description and drawings; it is to be understood, however, that the description and drawings are for the purpose of illustration only and are not intended to be definitive as to the scope of this invention.

DRAWINGS OF THE INVENTION

DETAILED DESCRIPTION OF THE INVENTION

Figure 1:
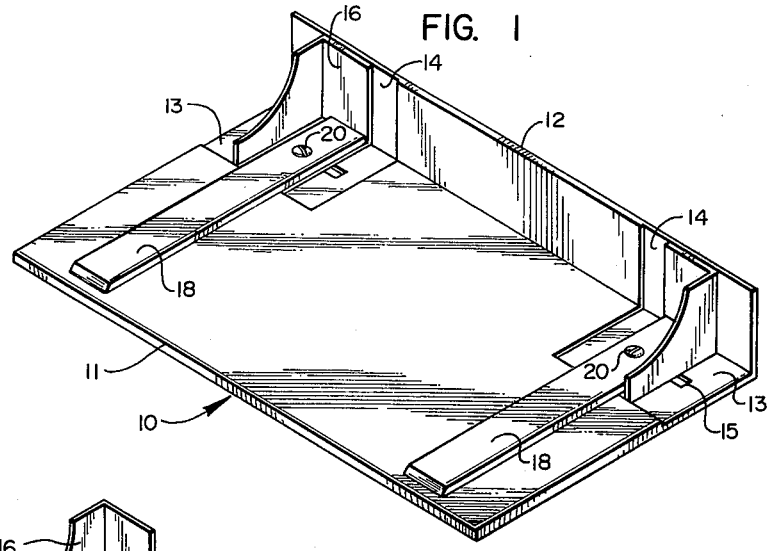
FIG. 1 is a perspective view of the paper tray assembly as claimed in the present invention.
Figure 2:
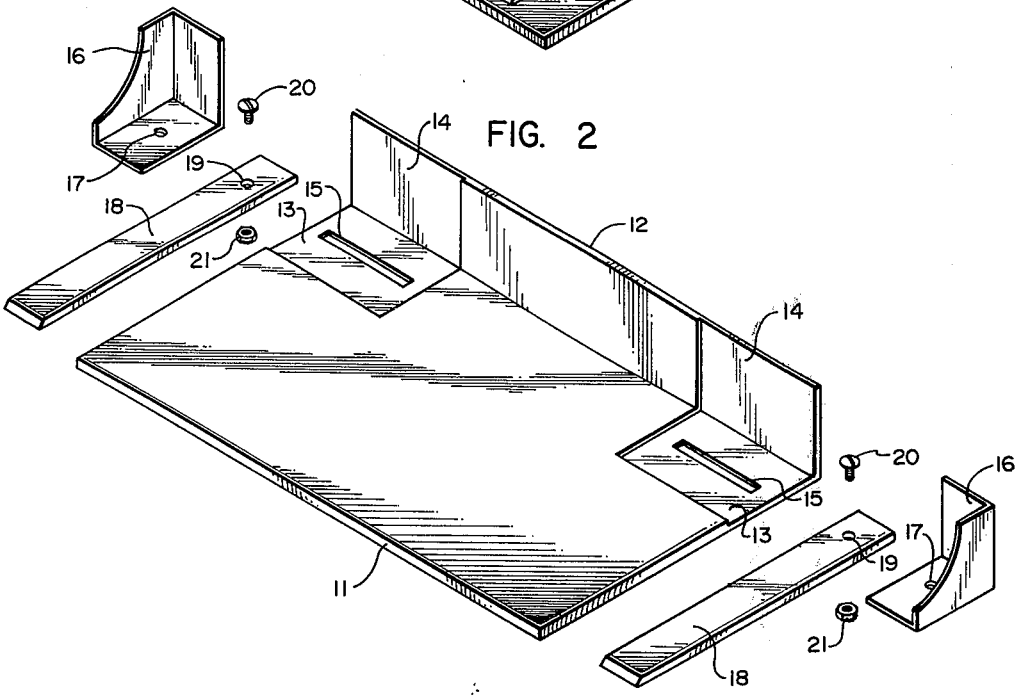
FIG. 2 illustrates the component parts making up the paper tray assembly of the present invention.
Figure 3:
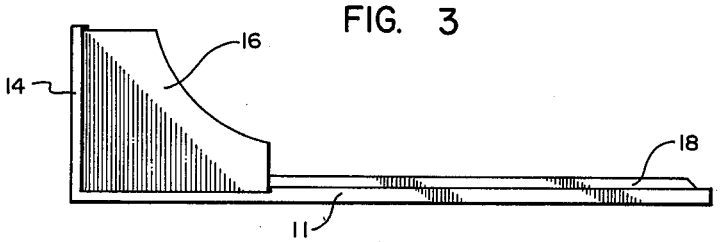
FIG. 3 is an end elevational view of the paper tray assembly of the present invention.
Figure 4:
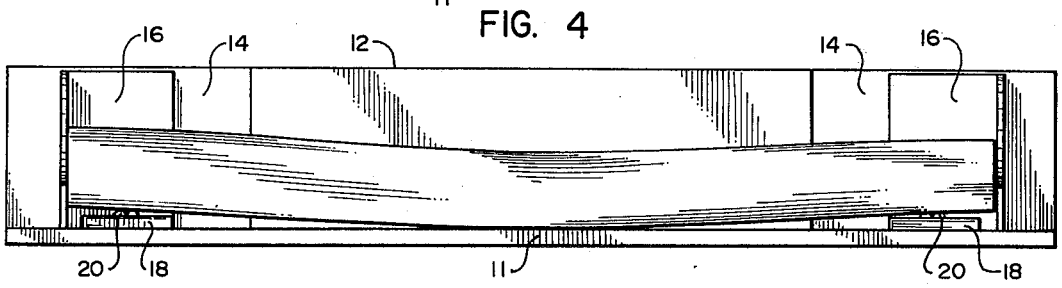
FIG. 4 is a front elevational view of the paper tray assembly of the present invention showing paper inserted therein.

Referring now to the drawings:

There is shown in FIGS. 1 through 4 an operative embodiment of the present invention. As illustrated in FIGS. 1 and 2, the paper tray assembly 10 consists of a flat base 11 having an upstanding backwall 12 which is contiguous with the base and extends upwardly at right angles therefrom. Located in the corners of the base adjacent the backwall are rectangular recesses 13. Coinciding with rectangular recesses 13 are similar recesses 14 in the inside surface of backwall 12. There is located in rectangular recesses 13 a longitudinal slot 15 which slot is parallel with the backwall 12. Slot 15 extends for a predetermined distance in rectangular recess 13. As illustrated, the slot is located midway between the edge of the recess and the opposing backwall. However, the slot can be located in any convenient position as long as the apertures in the other components of the tray assembly are in alignment with the slot.

Paper guide 16 is adapted to be slidably engaged in recesses 13 and 14 and consists of a floor, a backwall, and a sidewall. The floor and backwall being of substantially the same thickness as the depth of the recesses. In the paper guide, the height of the backwall, and the length of the floor extending transversely across the rectangular recess are of substantially the same height and width of the recesses. There is located in the floor of paper guide 16 an aperture, which when the paper guide is inserted into the recesses, will be in alignment with longitudinal slot 15.

Extending transversely across the base 11 and overlying the floor of paper guide 16 is a guide strip 18. As illustrated in the drawings, guide strip 18 is of a length substantially equal to the transverse width of base 11 and contains therein an aperture 19 adapted to be in alignment with aperture 17 in paper guide 16 and with slot 15. Fastening means in the form of a bolt or screw 20 and a nut 21 are used so as to secure the paper guide and guide strip to the base of the paper tray. Bolt 20 is inserted through apertures 19, 17 and slot 15 and secured by means of nut 21.

The guide strips function to hold the paper in the proper position so that the feeding mechanism contained in copying machines will remove and pass only one sheet at a time through the machine without clogging or jamming. When the paper is placed in a tray without benefit of the guide strips the paper is not held in a proper position and thus misfeeding and paper jams result.

As illustrated in the figures, the paper guides may be longitudinally adjusted by loosening bolt 20 and sliding both the paper guide 16 and guide strip 18 to the desired position and then retightening bolt 20. Thus by a simple adjustment the tray assembly can be adapted to hold letter size, legal size, or any other desired size of papers. If desired, to accommodate narrower paper, but without the benefit of the guide strip, the paper guides may be interchanged so that the end wall of each paper guide will be positioned on the inside portion of the recess instead of being positioned on the outside as illustrated in the drawings.

In operation, the tray assembly holding the desired size and color of paper is merely inserted into the paper repository of the copying machine. Ordinarily, copying machines of the type adapted to utilize the present invention will hold several reams of paper. Instead of requiring the changing of the complete supply of paper each time it is desired to make a paper change, it is only necessary to place the tray assembly of the present invention on the paper supply already existing in the copying machine. It will be obvious from this description that various trays adjusted to hold various sizes of papers and/or colors of papers may be stored in a rack and inserted into the paper repository of the copier for use as desired. The flexibility offered by this invention allows for greater utilization of a copying machine. The need for a key operator to change paper is eliminated. The key operator need only make certain that the paper trays are properly filled, since paper changes can then be made by other operators, key operators can be utilized for other productive work, and utilization of office personnel may become more flexible because of the simplified method of operation.

Although the invention has been described as being that which would form the preferred embodiment of the invention, it is recognized that departures may be made therefrom without departing from the scope of the invention which is not to be limited to the details disclosed, but is to be accorded the scope of the claims so as to include any and all equivalent devices.

What is claimed is:

1. A paper tray assembly comprising:

a. a flat base having a backwall extending upwardly at right angles to the base;

b. rectangular recesses in the corners of the base adjacent the backwall, each recess containing a longitudinal slot therein;

c. coinciding recesses in the backwall adjacent the rectangular base recesses;

d. a pair of longitudinally adjustable paper guides slidably engaged in said recesses having a floor, rearwall and end wall portions, said floor portion containing an aperture which is in alignment with the longitudinal slot, said paper guides being further characterized in that the endwalls are on the outside portion of the paper guide relative to the ends of the base and backwall;

e. a pair of guide strips extending transversely across the flat base, said guide strips having an aperture in one end and being adapted to fit over the floor of the paper guides in such a manner that said aperture is in alignment with the paper guide aperture and longitudinal slot;

f. fastening means extending through said apertures and longitudinal slots adapted to secure said paper guides and guide strips in any desired position along the longitudinal slots.

2. A paper tray assembly according to claim 1 wherein the depth of the rectangular base and backwall recesses are substantially the same as the thickness of the floor and rearwall portions of the paper guides.

3. A paper tray assembly according to claim 2 wherein the guide strips are parallel and extend from the backwall to the front edge of the base.

4. A paper tray assembly according to claim 3 wherein the paper guides may be slidably adjusted within the longitudinal slot to accommodate various sizes of papers.

5. A paper tray assembly according to claim 4 wherein the guide strips underlie the ends of the paper inserted between the endwalls of the paper guide.

* * * * *